US008070154B2

(12) United States Patent
Shih et al.

(10) Patent No.: US 8,070,154 B2
(45) Date of Patent: Dec. 6, 2011

(54) PAPER HOLDING DEVICE AND PRINTER WITH THE PAPER HOLDING DEVICE

(75) Inventors: Chih-Kun Shih, Santa Clara, CA (US); Chun-Hsien Lin, Taipei Hsien (TW); Chen-Lu Fan, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/784,715

(22) Filed: May 21, 2010

(65) Prior Publication Data

US 2011/0148031 A1 Jun. 23, 2011

(30) Foreign Application Priority Data

Dec. 18, 2009 (CN) ..... 2009 1 0311860

(51) Int. Cl.
*B65H 1/00* (2006.01)

(52) U.S. Cl. ..... 271/171; 271/223

(58) Field of Classification Search ..... 271/223, 271/171; 312/319.5–319.8; 108/20–22, 108/147

See application file for complete search history.

(56) References Cited

U.S. PATENT DOCUMENTS 5,362,144 A * 11/1994 Shioya et al. ..... 312/319.6
5,743,518 A * 4/1998 Takashimizu et al. ..... 271/4.1
7,484,730 B2 * 2/2009 Seike et al. ..... 271/223

FOREIGN PATENT DOCUMENTS

JP 04039256 A * 2/1992
JP 04333462 A * 11/1992

* cited by examiner

*Primary Examiner* — Kaitlin Joerger
(74) *Attorney, Agent, or Firm* — Altis Law Group, Inc.

(57) ABSTRACT

A paper holding device includes a paper tray, a sliding plate, and a driving mechanism. The paper tray is configured for receiving printed paper. A shaft is secured to the paper tray. The sliding plate is slidably attached to the paper tray. A main gear member is disposed on the sliding plate. The driving mechanism is secured to the sliding plate and capable of sliding the main gear member along the shaft to slide the sliding plate on the paper tray.

17 Claims, 7 Drawing Sheets

PAPER HOLDING DEVICE AND PRINTER WITH THE PAPER HOLDING DEVICE

BACKGROUND

1. Technical Field

The present disclosure relates to a paper holding device for receiving printed paper and a printer with the paper holding device.

2. Description of Related Art

Many printers print documents and output the documents to a paper tray. However, the size of the paper tray cannot automatically change to receive different size paper, particular larger paper.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
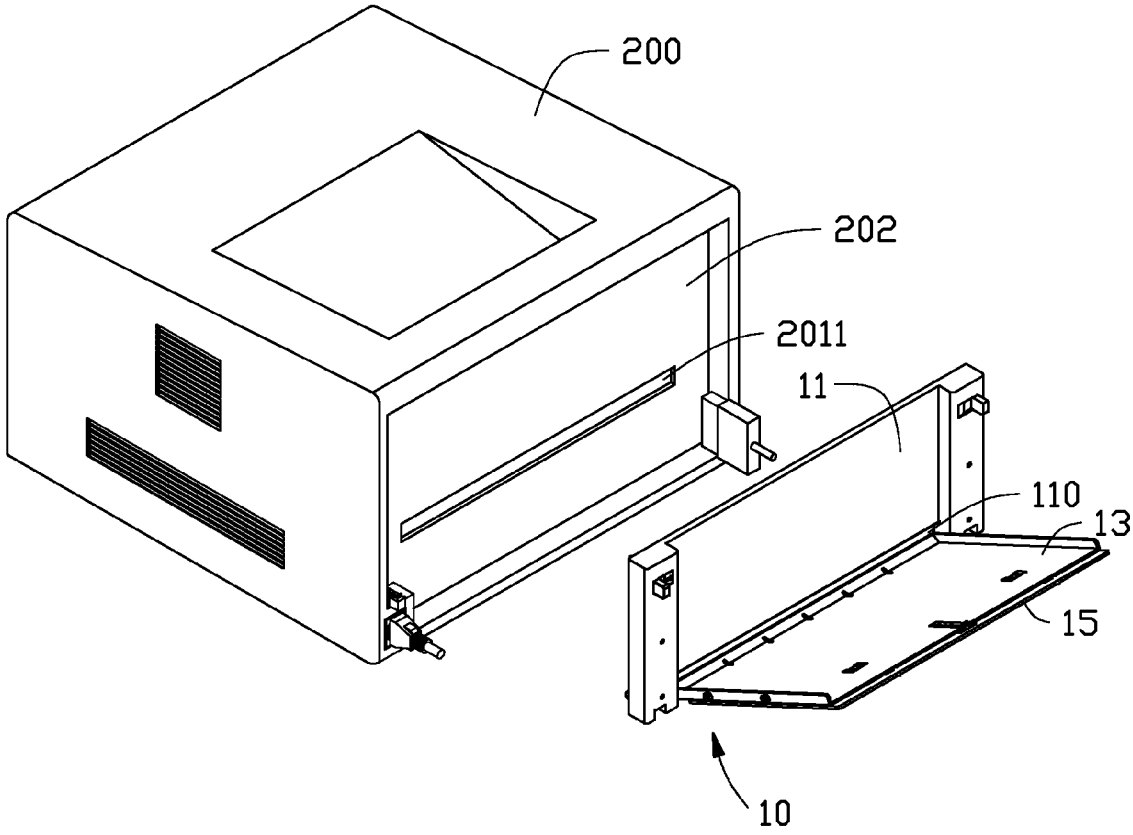
FIG. 1 is a partly exploded view of a printer in accordance with one embodiment.

Referring to FIG. 1, a printer in accordance with one embodiment includes a main body 200 and a paper holding device 10 attachable to the main body 200.

The main body 200 is capable of printing documents and outputting paper and includes a rear wall 202. An output opening 2011 is defined in the rear wall 202, for outputting the printed paper.

Figure 2:
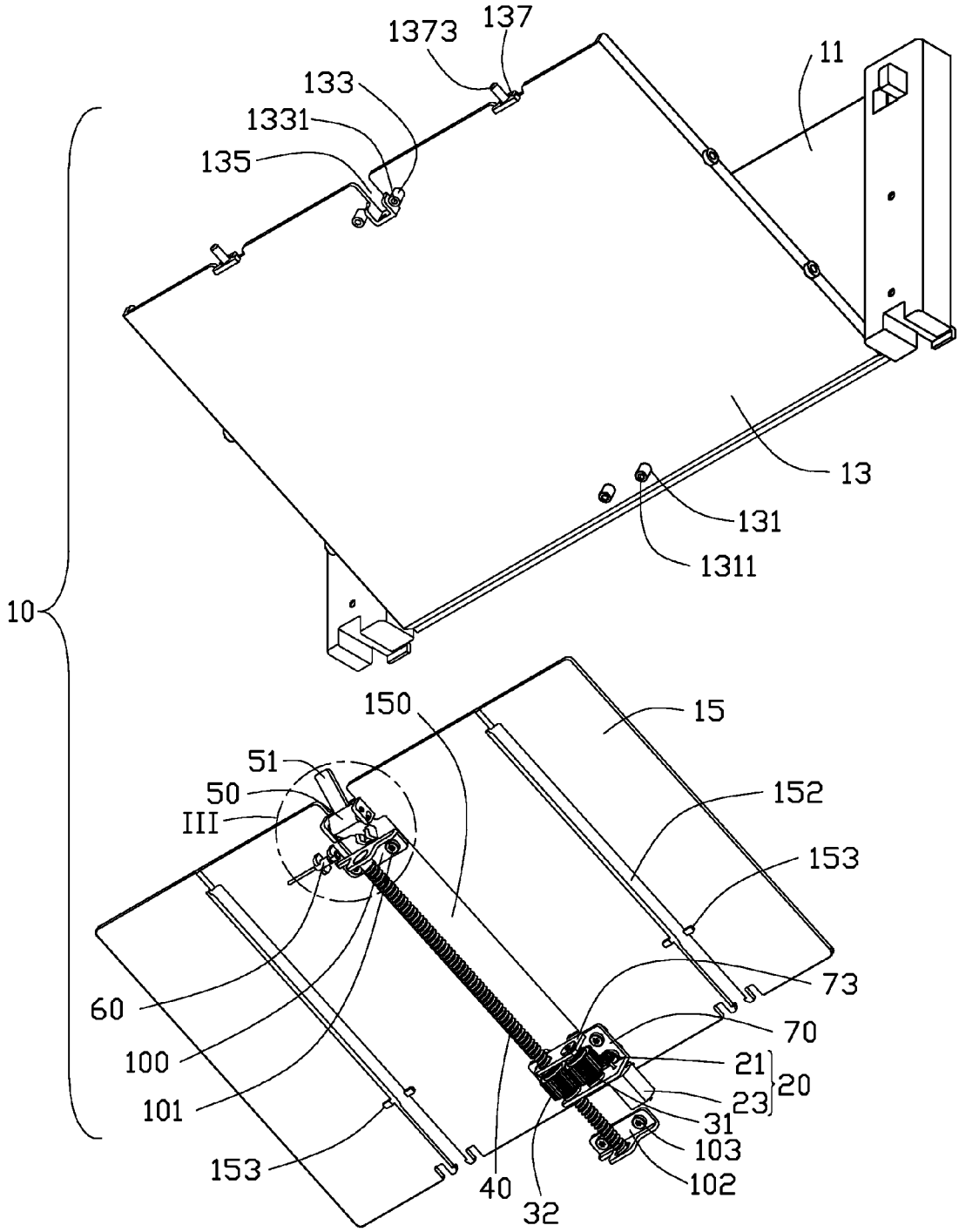
FIG. 2 is a partly exploded view of a paper holding device of FIG. 1.

Referring to FIG. 2, the paper holding device 10 includes a mounting member 11, a paper tray 13, and a sliding plate 15. The mounting member 11 is capable of being secured to the rear wall 202 of the main boy 200. The paper tray 13 is secured to the mounting member 11, and a gap 110 (shown in FIG. 1) is defined between the paper tray 13 and the mounting member 11, corresponding to the output opening 2011, for the printed paper inserted therethrough. Two mounting posts 131 each with a mounting hole 1311 are located on a bottom surface of the paper tray 13 adjacent a rear edge. Two guiding portions 137 each with a guiding post 1373 are located on a front edge of the paper tray 13. A cutout 135 is defined in the front edge of the paper tray 13 between the guiding portions 137. Two securing posts 133, each defining a securing hole 1331, is located on the bottom surface of the paper tray 13 adjacent the front edge, at two sides of the cutout 135.

Figure 3:
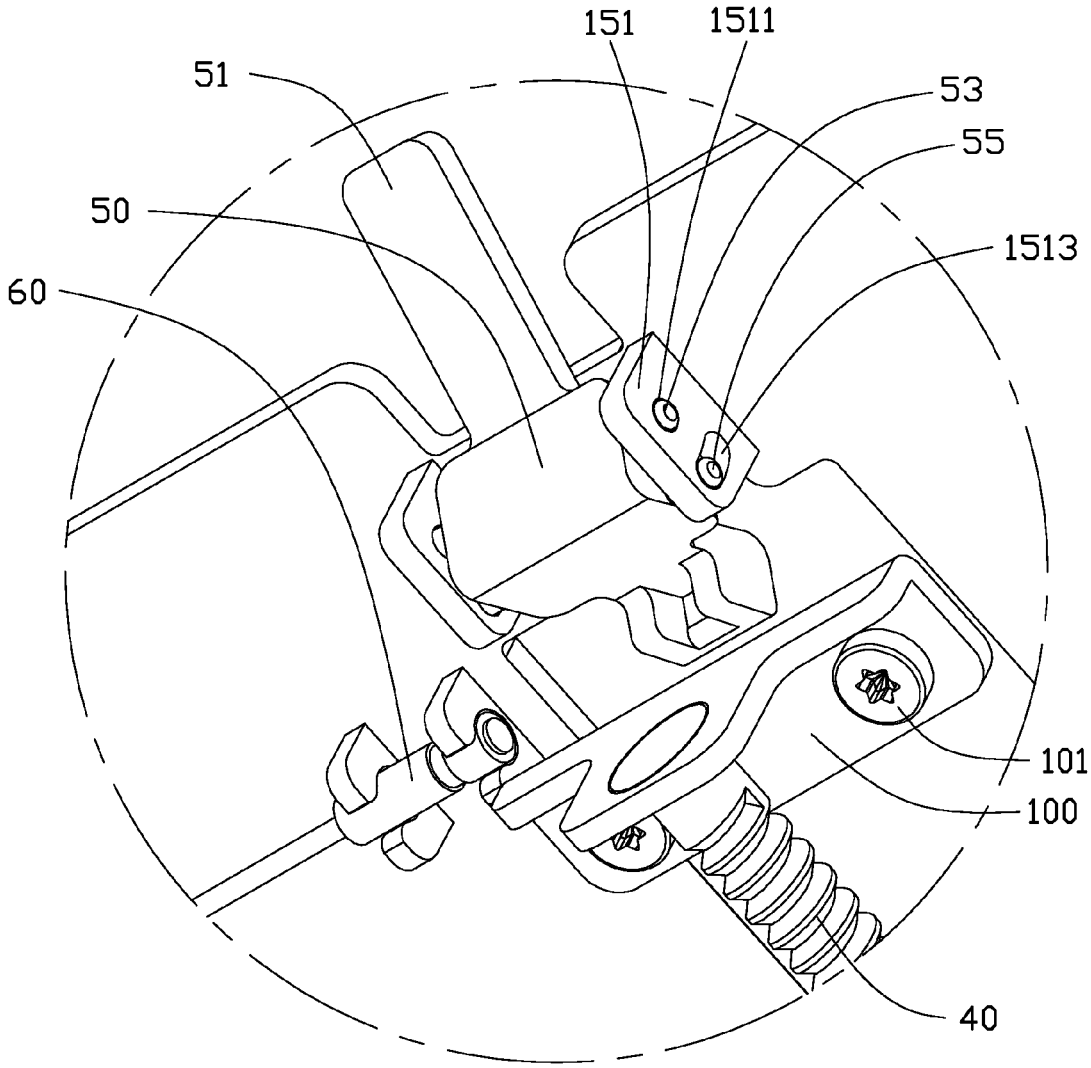
FIG. 3 an enlarged view of portion III of FIG. 2.

The sliding plate 15 defines a through opening 150 at a middle portion and two sliding slots 152 at two sides of the through opening 150. Two blocking tabs 153 are located on the bottom surface at two sides of each sliding slots 152, adjacent a rear edge of the sliding plate 15. Referring also to FIG. 3, a pair of positioning pieces 151 is located on a bottom surface of the sliding plate 15, between a front edge and the through opening 150. Each positioning piece 151 defines a pivot hole 1511 and a sliding slot 1513. In one embodiment, the sliding slots 1518 are arcuate.

Figure 4:
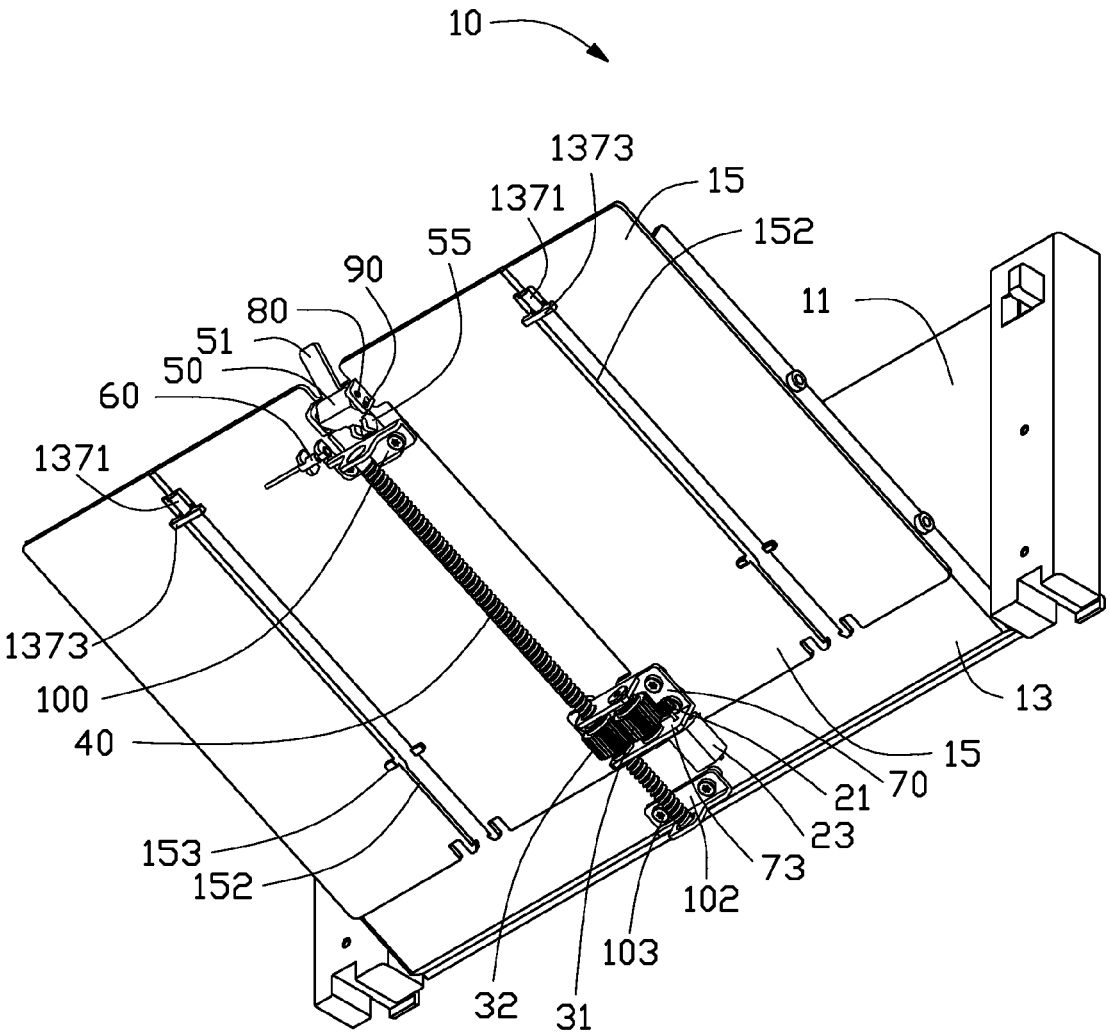
FIG. 4 is an assembled view of the paper holding device of FIG. 2.

Referring to FIG. 3, a rotating member 50 is secured between the positioning pieces 151 and includes an extending portion 51. A pair of pivot posts 53 and a pair of sliding posts 55 are located on the rotating member 50. The pivot posts 53 are received in the pivot holes 1511 of the positioning pieces 151, and the sliding posts 55 are received in the sliding slots 152. The rotating member 50 is rotatable about the pivot posts 53, and the sliding posts 55 are slidable in the sliding slots 1513 when the extending portion 51 is pressed by the printed paper. In one embodiment, the rotating member 50 serves as a sensor that can rotate in a first direction when the printed paper rotates the rotating member 50, and can rotate in a second direction opposite to the first direction when there is no printed paper on the rotating member 50. A sensor 60 is secured to the bottom surface of the sliding plate 15 adjacent the rotating member 50 and capable of detecting movement of the rotating member 50. Referring to FIGS. 2 and 4, a securing component 70 is secured to the bottom surface of the sliding plate 15 between the rear edge and the through opening 150. The securing component 70 includes a pair of securing pieces 73. An intermediate gear member 31 and a main gear member 32 are rotatably secured between the securing pieces 73. The intermediate gear member 31 meshes with the main gear member 32. The main gear member 32 is internally threaded along an axis thereof and a shaft 40 is screwed into the main gear member 32 and inserted through the securing pieces 73.

A driving mechanism 20 is secured to the bottom surface of the sliding plate 15 adjacent the securing component 70. The driving mechanism 20 includes a motor 23 and a driving gear member 21. The motor 23 is capable of being controlled by the sensor 60 to rotate the driving gear member 21. The driving gear member 21 is secured between the securing pieces 73 of the securing component 70 and meshes with the intermediate gear member 31.

Figure 5:
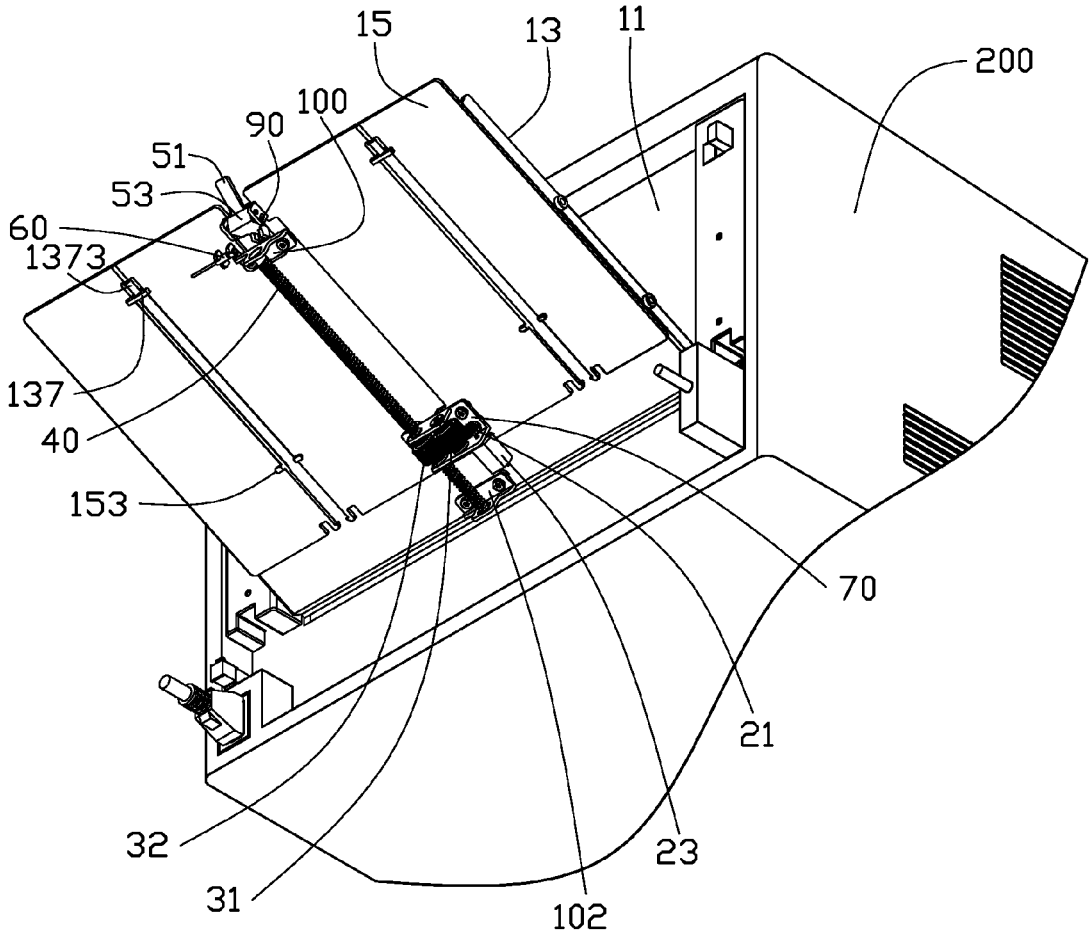
FIG. 5 is an assembled, cutaway view of FIG. 1, showing from a different aspect.

Referring to FIGS. 1 and 3, the sliding plate 15 is attached to the bottom surface of the paper tray 13. The guiding portions 137 are received in the sliding slots 152. The shaft 40 is rotatably secured to a first fixing member 100 and a second fixing member 102. The first fixing member 100 is secured to the securing posts 133 via the through opening 150, with two first fasteners 101, such as screws, used in the securing holes 1331. The second fixing member 102 is secured to the mounting posts 131, with two second fasteners 103, such as screws, screwed into the mounting holes 1311. Referring also to FIG. 5, the mounting member 11 of the paper holding device 10 is secured to the rear wall 202 of the main body 200, with the gap 110 aligned with the output opening 2011.

Figure 6:
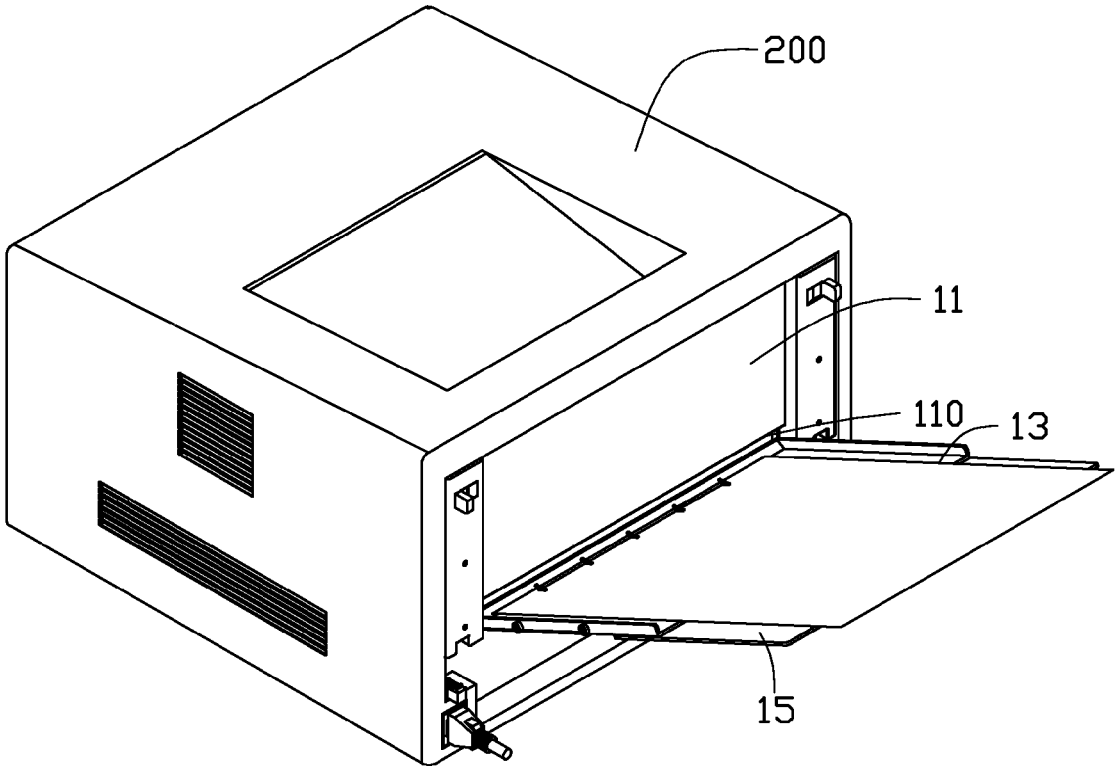
FIG. 6 is an assembled view of FIG. 1, and showing the sliding plate in another position.
Figure 7:
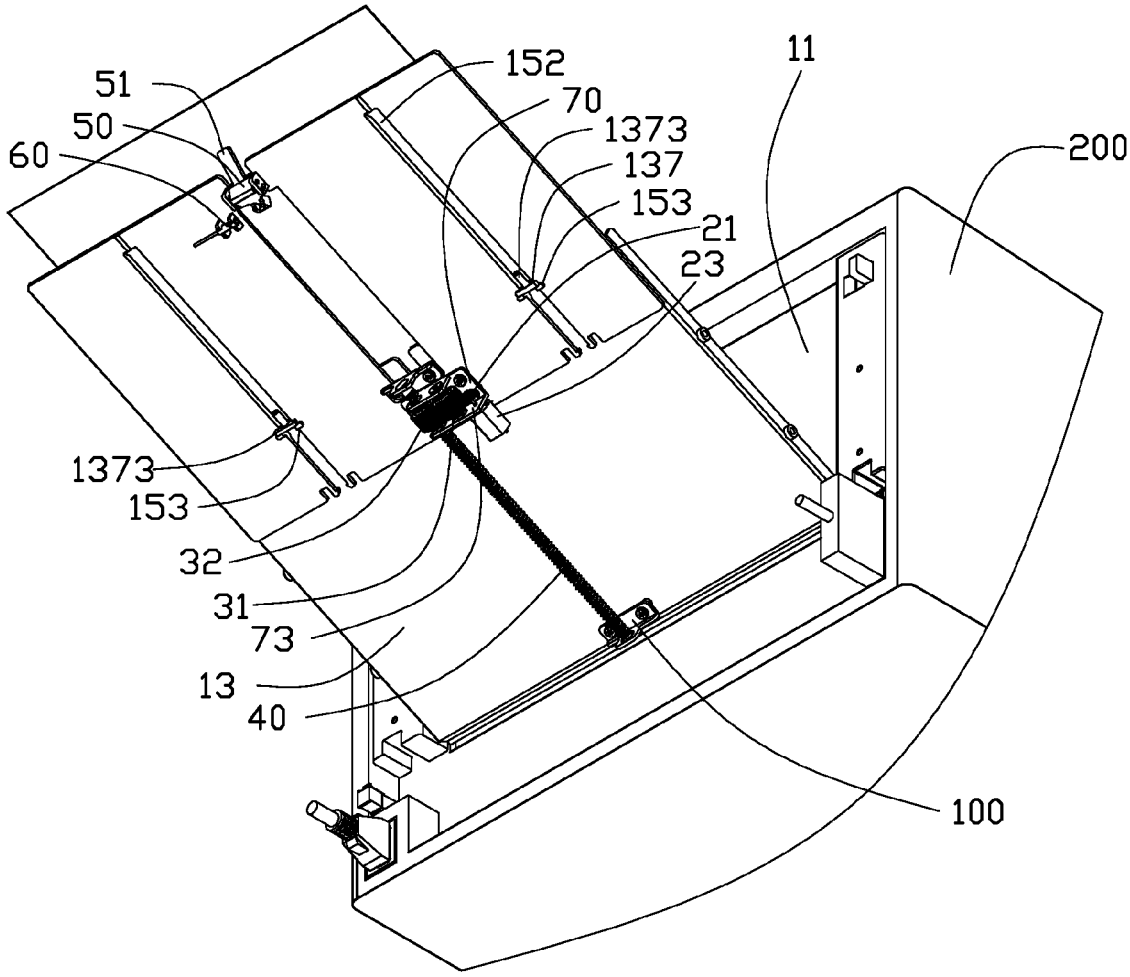
FIG. 7 is similar to FIG. 6, but shown from a different aspect.

The sliding plate 15 is slidable between a first position (shown in FIG. 5), where the guiding posts 1373 of the guiding portions 137 abut against front edges of the sliding slots 152, and the extending portion 51 of the rotating member 50 extends above the paper tray 13, and a second position (shown in FIGS. 6-7), where the guiding portions 137 abut on the blocking tabs 153.

In use, a printed paper is output from the output opening 2011 and passes through the gap 110 to the paper tray 13. If the printed paper is long enough to press against and rotate the extending portion 51 of the rotating member 50 along a first direction, the sensor 60 detects movement of the rotating member 50 and controls the motor 23 to rotate the driving gear member 21 in a second direction. At this time, the intermediate gear member 31 is thereby rotated by the driving gear member 21, and the main gear member 32 is rotated relative to the shaft 40 by the intermediate gear member 31. Because the main gear member 32 is slidably threaded with the shaft 40 and the shaft 40 is fixed on the paper tray 13, the main gear member 32 is slid along the shaft 40. The sliding plate 15 is pushed by the main gear member 32 to slide along the paper tray 13 in a third direction and expose out of the paper tray 13. Thus the sliding plate 15 and the paper tray 13 together support the long printed paper.

After the printed paper is taken out from the paper holding device 10, the rotating member 50 is no longer pressed by the printed paper, and the rotating member 50 is thereby rotated opposite to the first direction. The sensor 60 detects the movement of the rotating member 50 and controls the motor 23 to rotate the driving gear member 21 opposite to the second direction. The sliding plate 15 is thereby pushed by the main gear member 32 to slide opposite to the third direction and is drawn back under the paper tray 13 ready for accommodating short printed paper. In this way paper of more than one size can be accommodated and held neatly stacked in the paper tray 13

It is to be understood, however, that even though numerous characteristics and advantages have been set forth in the foregoing description of embodiments, together with details of the structures and functions of the embodiments, the disclosure is illustrative only and changes may be made in detail, especially in matters of shape, size, and arrangement of parts within the principles of the disclosure to the full extent indicated by the broad general meaning of the terms in which the appended claims are expressed.

What is claimed is:

1. A paper holding device comprising:

a paper tray for receiving printed paper, a shaft secured to the paper tray and a guiding portion located on an edge of the paper tray;

a sliding plate slidably attached to the paper tray and defining a sliding slot, two blocking tabs located on opposite sides of the sliding slot, a main gear member disposed on the sliding plate; and a driving mechanism secured to the sliding plate, the driving mechanism capable of sliding the main gear member along the shaft to slide the sliding plate on the paper tray;

wherein the sliding plate is slidable, relative to the paper tray, between a first position, where the guiding portion abuts a front edge of sliding slot, and a second position, where the guiding portion abuts on the two blocking tabs.

2. The paper holding device of claim 1, wherein a securing component is secured to the sliding plate and comprises a pair of securing pieces; and the main gear member is secured to the securing component between the pair of securing pieces.

3. The paper holding device of claim 2, wherein the driving mechanism comprises a motor and a driving gear member capable of being rotated by the motor; an intermediate gear member is rotatably secured to the securing component between the pair of securing pieces; the main gear member meshes with the intermediate gear member, and the intermediate gear member meshes with the driving gear member.

4. The paper holding device of claim 3, wherein the motor is controlled by a sensor.

5. The paper holding device of claim 4, wherein a rotating member is located on the sliding plate and extends out of the paper tray, the rotating member is capable of being rotated when pressed by printed piece of paper; and the sensor instructs the motor to rotate the driving gear member when movement of the rotating member is detected.

6. A printer comprising:

a main body capable of printing and outputting printed paper; and a paper holding device attached to the main body, the paper holding device comprising:

a paper tray for receiving the printed paper, a shaft secured to the paper tray and a guiding portion located on an edge of the paper tray;

a sliding plate slidably attached to the paper tray, a positioning piece extending a bottom surface of the sliding plate, and a sliding slot defined in the positioning piece, a main gear member disposed on the sliding plate and capable of sliding along the shaft when the main gear member is rotated;

a rotating member rotatably attached to the positioning piece and extends out of the paper tray, a sliding post extending from the rotating member and slidably received in the sliding slot of the positioning piece; and a driving mechanism secured to the sliding plate, the driving mechanism capable of driving and sliding the main gear member along the shaft so that the sliding plate is capable of sliding on the paper tray;

wherein the sliding plate is slidable, relative to the paper tray, between a first position, where the guiding portion abuts a front edge of sliding slot, and a second position, where the guiding portion abuts on the two blocking tabs.

7. The printer of claim 6, wherein a securing component is secured to the sliding plate and comprises a pair of securing pieces; and the main gear member is secured to the securing component between the pair of securing pieces.

8. The printer of claim 7, wherein the driving mechanism comprises a motor and a driving gear member capable of being rotated by the motor; an intermediate gear member is rotatably secured to the securing component between the pair of securing pieces; the main gear member meshes with the intermediate gear member, and the intermediate gear member meshes with the driving gear member.

9. The printer of claim 8, wherein the motor is controlled by a sensor.

10. The printer of claim 6, wherein the sliding plate defines a through opening, and one end of the shaft is secured to the paper tray via the through opening.

11. The printer of claim 6, wherein the paper holding device further comprises a mounting member; the paper tray is secured to the mounting member; and the paper holding device defines a gap between the paper tray and the mounting member.

12. A printer comprising:

a main body capable of printing and outputting printed paper;

a paper tray attached to the main body for receiving the printed paper, a shaft secured to the paper tray, and a guiding portion located on an edge of the paper tray;

a sliding plate slidably attached to the paper tray and defining a sliding slot, two blocking tabs located on opposite sides of the sliding slot, a securing component secured to the sliding plate and comprising a pair of securing pieces, a main gear member rotatably secured to the securing component between the pair of securing pieces, the main gear member capable of sliding along the shaft and sliding the sliding plate by pushing the securing component when the main gear member is rotated; and a driving mechanism secured to the sliding plate, the driving mechanism capable of rotating and sliding the main gear member along the shaft so that the sliding plate is capable of sliding on the paper tray between a first position, where the guiding portion abuts a front edge of sliding slot, and a second position, where the guiding portion abuts on the two blocking tabs.

13. The printer of claim 12, wherein the driving mechanism comprises a motor and a driving gear member capable of being rotated by the motor; an intermediate gear member is rotatably secured to the securing component between the pair of securing pieces; the main gear member meshes with the intermediate gear member, and the intermediate gear member meshes with the driving gear member.

14. The printer of claim 13, wherein the motor is controlled by a sensor.

15. The printer of claim 14, wherein a rotating member is located on the sliding plate and extends out of the paper tray, the rotating member is capable of being rotated when pressed by the printed piece of paper; and the sensor instructs the motor to rotate the driving gear member when movement of the rotating member is detected.

16. The printer of claim 15, wherein the sliding plate defines a through opening, and one end of the shaft is secured to the paper tray via the through opening.

17. The printer of claim 12, further comprising a mounting member, the paper tray secured to the mounting member, and a gap defined between the paper tray and the mounting member.

* * * * *